US009829229B2

(12) United States Patent
Harras

(10) Patent No.: US 9,829,229 B2
(45) Date of Patent: Nov. 28, 2017

(54) SYSTEM AND METHOD FOR DETECTING LOW REFRIGERANT CHARGE IN A REFRIGERATION SYSTEM

(71) Applicant: JOHNSON CONTROLS TECHNOLOGY COMPANY, Holland, MI (US)

(72) Inventor: Jeffrey H. Harras, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 62 days.

(21) Appl. No.: 14/800,080

(22) Filed: Jul. 15, 2015

(65) Prior Publication Data

US 2016/0216017 A1 Jul. 28, 2016

Related U.S. Application Data

(60) Provisional application No. 62/108,138, filed on Jan. 27, 2015.

(51) Int. Cl.
*F25B 45/00* (2006.01)
*F25B 49/00* (2006.01)

(52) U.S. Cl.
CPC ..... *F25B 49/005* (2013.01); *F25B 2500/24* (2013.01); *F25B 2600/01* (2013.01); *F25B 2600/0251* (2013.01); *F25B 2700/04* (2013.01); *F25B 2700/2106* (2013.01); *F25B 2700/21163* (2013.01)

(58) Field of Classification Search
CPC ..... F25B 45/00; F25B 2345/001; F25B 2345/003; F25B 49/005; F25B 2500/24; F25B 2600/01; F25B 2700/21163; F25B 2700/04; F25B 2700/2106; F25B 2600/0251
USPC ..... 62/129
See application file for complete search history.

(56) References Cited

U.S. PATENT DOCUMENTS 5,809,795 A * 9/1998 Beaverson ..... F25B 41/065 62/218
6,513,521 B1 * 2/2003 Gier ..... A41D 13/0053 128/201.21
6,826,917 B1 * 12/2004 Bodell, II ..... F25B 49/022 62/115
7,164,242 B2 * 1/2007 Federman ..... F25B 49/025 318/400.21
2005/0126191 A1 * 6/2005 Lifson ..... F25B 49/005 62/129
2005/0223724 A1 * 10/2005 Crane ..... F25B 49/025 62/175
2006/0042276 A1 * 3/2006 Doll, Jr. ..... F25B 49/005 62/129
2007/0144193 A1 * 6/2007 Crane ..... F25B 49/022 62/228.4
2010/0186430 A1 * 7/2010 Johnston ..... B60H 1/00585 62/77
2011/0259023 A1 * 10/2011 Doll, Jr. ..... F25B 49/005 62/129

(Continued)

*Primary Examiner* — Mohammad M Ali
(74) *Attorney, Agent, or Firm* — Fletcher Yoder, PC

(57) ABSTRACT

Systems and methods are provided for detecting low refrigerant charge in a refrigeration system. Specifically, the present invention provides systems and methods for comparing refrigerant charges of the refrigeration system during at least substantial shut down.

21 Claims, 2 Drawing Sheets

(56) References Cited

U.S. PATENT DOCUMENTS

| | | | | |
|---|---|---|---|---|
| 2012/0011867 | A1* | 1/2012 | Koons | F25B 39/04 62/115 |
| 2012/0192579 | A1* | 8/2012 | Huff | B60H 1/3232 62/115 |

* cited by examiner

SYSTEM AND METHOD FOR DETECTING LOW REFRIGERANT CHARGE IN A REFRIGERATION SYSTEM

BACKGROUND OF THE DISCLOSURE

The present disclosure relates generally to a system and method for detecting low refrigerant charge in a refrigeration system.

Compression refrigeration systems, including refrigeration, HVAC, and air conditioning systems (collectively hereinafter "refrigeration") may experience refrigerant leakage as a result of degradation of system components. For example, degradation of seals, piping, and component connections can lead to leakage of refrigerant. In addition to undesirable environmental hazards posed by refrigerant leakage, system performance and efficiency rapidly deteriorates from low refrigerant charge, resulting in energy inefficiency, as well as potential unscheduled system shut down and possible damage to system components.

Therefore, what is needed is a system and method for detecting low refrigerant charge of a refrigeration system.

SUMMARY OF THE DISCLOSURE

One embodiment includes a system for detecting low refrigerant charge in a refrigeration system including a compressor, a condenser, and an evaporator interconnected by a refrigerant line and forming a closed refrigerant circuit. The system further includes at least one sensor to sense at least a refrigerant charge associated with at least substantial shut down of the system of sufficient time duration such that temperatures of the condenser and evaporator are substantially equal to each other. A control panel includes a microprocessor, a memory device and an interface board, the control panel being in communication with the sensor to receive data signals corresponding to at least the refrigerant charge associated with the at least substantial shut down of the system. The memory device storing data corresponds to a value of at least a sensed refrigerant charge associated with a previous at least substantial shut down of the system. The system further includes the microprocessor executing a computer algorithm to compare the received data signals corresponding to the refrigerant charge associated with at least substantial shut down of the system with the corresponding value from the data for the sensed refrigerant charge associated with a previous at least substantial shut down of the system, to detect a system defect relating to low refrigerant charge based on the comparison and to generate an alert for a user in response to the detection of the system defect. The system further includes the interface board transmitting the at least one alert to a user interface.

Another embodiment includes a method of detecting low refrigerant charge in a refrigeration system including performing at least substantial shut down of the system and sensing a refrigerant charge associated with the at least substantial shut down of the system. The method further includes comparing the refrigerant charge associated with the at least substantial shut down of the system with a refrigerant charge associated with a previous at least substantial shut down of the system. The method further includes generating an alert in response to a predetermined reduction of the refrigerant charge.

Further aspects of the method and system are disclosed herein. The features as discussed above, as well as other features and advantages of the present disclosure will be appreciated and understood by those skilled in the art from the following detailed description and drawings.

BRIEF DESCRIPTION OF THE DRAWINGS

Wherever possible, the same reference numbers will be used throughout the drawings to refer to the same or like parts.

DETAILED DESCRIPTION OF THE DISCLOSURE

Figure 1:
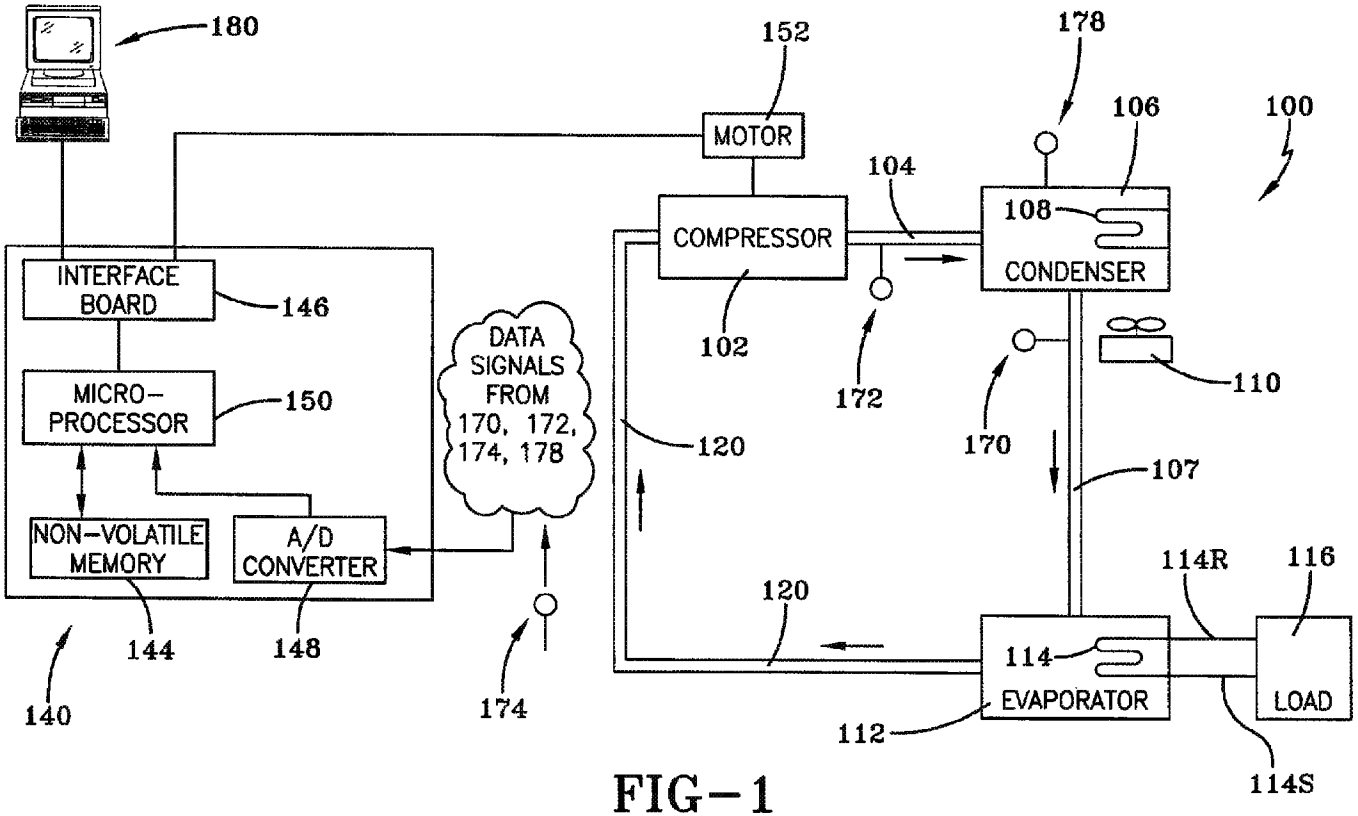
FIG. 1 illustrates schematically a refrigeration system of the present invention.

A general system to which the invention can be applied is illustrated, by means of example, in FIG. 1. As shown, the system 100, whether an HVAC, refrigeration, or liquid chiller system, includes a compressor 102, a condenser 106, a water chiller or evaporator 112, and a control panel 140. The control panel 140 can include an analog to digital (A/D) converter 148, a microprocessor 150, a non-volatile memory 144, and an interface board 146. The features and operation of the control panel 140 will be discussed in greater detail below. The conventional liquid chiller system 100 includes many other features that are not shown in FIG. 1. These features have been purposely omitted to simplify the drawing for ease of illustration.

Compressor 102 compresses a refrigerant vapor and delivers the vapor to the condenser 106 through a discharge line 104. In one embodiment, the compressor 102 is a centrifugal compressor, although in other embodiments, other types of compressors, such as screw, scroll, and reciprocating compressors can be used. To drive the compressor 102, the system 100 includes a motor or drive mechanism 152 for compressor 102. While the term "motor" is used with respect to the drive mechanism for the compressor 102, it is to be understood that the term "motor" is not limited to a motor but is intended to encompass any component that can be used in conjunction with the driving of motor 152, such as a variable speed drive and a motor starter. In a preferred embodiment of the present invention, the motor or drive mechanism 152 is an electric motor and associated components. However, other drive mechanisms such as steam or gas turbines or engines and associated components can be used to drive the compressor 102.

The refrigerant vapor delivered by the compressor 102 to the condenser 106 enters into a heat exchange relationship with a fluid, e.g., air or water, and undergoes a phase change to a refrigerant liquid as a result of the heat exchange relationship with the fluid. The condensed liquid refrigerant from condenser 106 flows through an expansion device (not shown) to an evaporator 112. In an exemplary embodiment, the refrigerant vapor in the condenser 106 enters into the exchange relationship with water, air, or another fluid, flowing through the secondary circuit of a heat exchanger 108 or the condenser 106 and its coils can be cooled by air, and assisted by a condenser fan 110. The refrigerant vapor in the condenser 106 undergoes a phase change to a refrigerant liquid as a result of the heat exchange relationship with the water in the secondary circuit of the heat exchanger 108 or the air passing through the condenser.

The evaporator 112 can be of any type, such as, but not limited to a shell and tube or coil-type evaporator. As shown in FIG. 1, evaporator 112 includes a heat exchanger coil 114 having a supply line 114S and a return line 114R connected to a cooling load 116. The heat exchanger coil 114 can include a plurality of tube bundles within the evaporator 112. A secondary liquid, which is typically water, but can be any other suitable secondary liquid, e.g., ethylene, calcium chloride brine or sodium chloride brine, travels into the evaporator 112 via return line 114R and exits the evaporator 112 via supply line 114S. The liquid refrigerant in the evaporator 112 enters into a heat exchange relationship with the secondary liquid in the heat exchanger coil 114 to chill the temperature of the secondary liquid in the heat exchanger coil 114. The refrigerant liquid in the evaporator 112 undergoes a phase change to a refrigerant vapor as a result of the heat exchange relationship with the secondary liquid in the heat exchanger coil 114. The vapor refrigerant in the evaporator 112 exits the evaporator 112 and returns to the compressor 102 by a suction line 120 to complete the cycle. While the system 100 has been described in terms of preferred embodiments for the condenser 106 and evaporator 112, it is to be understood that any suitable configuration of condenser 106 and evaporator 112 can be used in the system 100, provided that the appropriate phase change of the refrigerant in the condenser 106 and evaporator 112 occurs.

As further shown in FIG. 1, the control panel 140 has an A/D converter 148 to receive input signals from the system 100 that include data relating to performance parameters of various components of the system 100. System 100 includes a plurality of sensors communicably linked to the control panel 140 for gathering data and relaying signals to the control panel 140 for processing. For example, the input signals received by the control panel 140 can include at least one sensor, such as sensor 178 to sense at least a refrigerant charge associated with at least substantial shut down of the system 100. In one embodiment, sensor 178 is a capacitance probe that can be used to detect a level of liquid refrigerant in the condenser 106. In another embodiment, one or more suitable components capable of directly measuring condenser liquid refrigerant level, such as optical and/or ultrasonic sensor(s) may be used.

For purposes of the present disclosure, the terms "sensing" and "measuring" and the like may be used interchangeably.

For purposes of the present disclosure, "substantial shut down" is intended to include system operating conditions, such as compressor inaction, but also includes operating conditions in which an amount of refrigerant is being circulated in a refrigeration system, such as by operation of an oil pump for maintaining lubrication of compressor motor shaft seals. The compressor must not be spinning to be considered a "substantial shut down."

In an exemplary embodiment of FIG. 1, optionally a refrigerant line temperature sensor 170, preferably located in immediate proximity to the condenser 106 liquid outlet, may be used in combination with an ambient temperature sensor 174 and a timer 172. Based on previous data collected in response to the at least substantial shut down of the system, which may include ambient temperature readings associated with a sufficient passage of time as measured by timer 172, as controlled by microprocessor 150, the level of liquid refrigerant or refrigerant charged sensed by sensor 178 is compared with previous level(s) of liquid refrigerant or refrigerant charge sensed by sensor 178. In one instance, the compared data collected corresponds to the most recent at least substantial shut down of the system.

The control panel 140 is communicably connected to each sensor, and is also preferably connected to an interface board 146 to transmit signals, whether by wired or wireless means, to a user interface or display 180. Optionally, the interface board 146 can further transmit signals to components of the system 100 to control the operation of the system 100, such as the speed of the motor, the position of any capacity control device, and the like. The control panel 140 may also include many other features and components that are not shown in FIG. 1. These features and components have been purposely omitted to simplify the control panel 140 for ease of illustration.

The control panel 140 uses one or more control algorithms to receive and process signals received from the various sensors of the system 100. In one embodiment, the control algorithm includes establishing and storing data such as in one operating map, such as in non-volatile memory 144, and preferably a family of operating maps, that can be used as a reference to detect whether the system 100 has a low refrigerant charge.

Low refrigerant charge is intended to mean a sufficient loss of refrigerant charge based on a comparison of a sensed refrigerant charge associated with a previous at least substantial shut down of the system with a sensed refrigerant charge associated with a current at least substantial shut down of the system.

The data or operating map includes stored data that can only be overwritten in limited circumstances. In a preferred embodiment, the stored data is contained in non-volatile memory 144 so as to prevent unintended or unauthorized deletion or overwriting of the data. In one embodiment, the stored data is preprogrammed and is derived from system design and testing under known conditions, such as in a controlled factory environment prior to installation. In another embodiment, the stored data is derived from actual system operation conducted during an initialization stage, preferably conducted immediately following installation of the system 100 in the field and operation of the system at specific operating conditions, which in this case corresponds to at least substantial shut down of the system. Preferably, the initialization stage, and any subsequent data gathering, are preceded by at least a minimum operating period or interval so as to achieve stabilized system conditions, such as a predetermined time period or interval after substantial shut down of the system, such as a predetermined time period or interval sufficient for a temperature of liquid refrigerant of a condenser of the system to be substantially equal to a temperature of liquid refrigerant of an evaporator of the system. Initialization can also be performed upon restarting of the system after conducting significant repairs. In either embodiment, the system 100 allows for periodic re-populating of the stored data to correlate with actual system performance in the installed environment. For example, the control 140 of the system 100 may include password access or other security features that allow authorized personnel to run an initialization algorithm upon system installation, after system repairs, or following shut down.

Once the system 100 is installed and the reference map data is stored, whether by using factory data or through an initialization process, the system 100 is operated. During system operation, most notably during substantial shut down, the sensors of the system 100 generate and transmit signals containing data to the control 140. The microprocessor 150 of the control panel 140 runs at least one algorithm to compare the received signal data to the corresponding preprogrammed data in the operating map. For example, a sensed refrigerant charge associated with a previous at least substantial shut down of the system is compared with a sensed refrigerant charge associated with a current at least substantial shut down of the system. If the sensed refrigerant charges falls within a preselected range or values stored in the reference map, no action is taken by the control 140. However, if the control algorithm determines that the loss of refrigerant of the received signal data falls outside of a preselected range of the corresponding reference map, a system defect is detected. If a system defect is detected, the control 140 preferably records and stores the data relating to the defect. More preferably, the control 140 generates a system alert. Most preferably, the system alert is also transmitted to maintenance personnel, such as by transmitting the alert to a user interface 180 communicably connected to the control 140. Additionally, if the signal data exceeds a preselected threshold, the control 140 can prevent start up or prevent resumption of the system 100 from substantial shut down to avoid possible damage to system components.

In one embodiment, the system defect relating to low refrigerant charge corresponds to the refrigerant charge associated with the at least substantial shut down of the system being between about 2 percent and about 10 percent less than the corresponding value from the data for the sensed refrigerant charge associated with a previous at least substantial shut down of the system (i.e., between about 2 percent and 10 percent); about 2 percent and about 5 percent; about 3 percent and about 5 percent; about 4 percent and about 5 percent; about 2 percent; about 3 percent; about 4 percent; about 5 percent, or any combination or sub-combination thereof In one embodiment, the control algorithm(s) can be computer programs stored in non-volatile memory 144 having a series of instructions executable by the microprocessor 150. While it is preferred that the control algorithm be embodied in a computer program(s) and executed by the microprocessor 150, it is to be understood that the control algorithm may be implemented and executed using digital and/or analog hardware by those skilled in the art. If hardware is used to execute the control algorithm, the corresponding configuration of the control panel 140 can be changed to incorporate the necessary components and to remove any components that may no longer be required, e.g. the A/D converter 148.

Using the system 100 of FIG. 1, a process is provided for determining a low refrigerant charge. The process begins by generating a reference map of data for the system. As previously described, to obtain the initial reference map values, the installed system 100 is preferably initialized by operating with a full refrigerant charge associated with at least substantial shut down of the system. Subsequently, such as during substantial shut down of the system, additional data representative of the current refrigerant charge of the system is obtained from the measured values from signals generated by the sensors, such as sensor 178. The initial refrigerant charge is then compared to the current or subsequently measured refrigerant charge, and an alert is generated in response to a predetermined reduction of the refrigerant charge.

Figure 2:
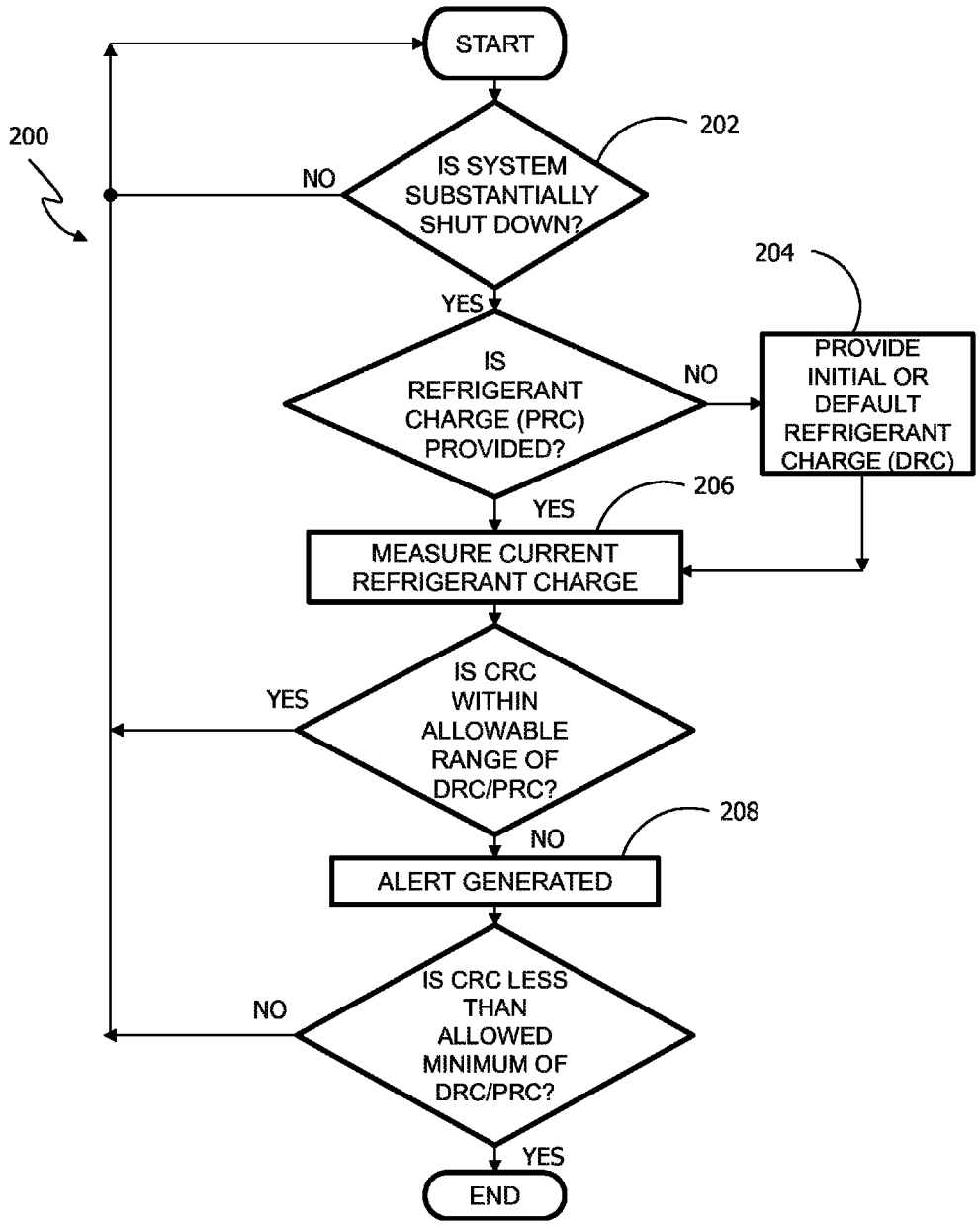
FIG. 2 illustrates a state diagram for the control system and method of the present invention for use with the refrigeration system illustrated in FIG. 1.

FIG. 2 is a state diagram representation of a preferred control algorithm of the present invention for establishing, storing, and utilizing operating maps to monitor refrigerant charge. The control algorithm may be executed as a separate program with respect to other control algorithms for the system or can be incorporated into other control algorithms of the system 100.

FIG. 2 illustrates a preferred embodiment of a refrigerant charge monitoring algorithm 200 of the present invention. As shown in FIG. 2, a state diagram 200 for one embodiment of the refrigerant charge monitoring algorithm of the present invention of FIG. 1 has four primary control states. The primary control states in this embodiment include: a substantial shut down state 202, an initialization state 204, a monitoring state 206 and an alert state 208. The substantial shut down state 202 is the first control state in the refrigerant charge monitoring algorithm 200. Upon starting or initiating the monitoring algorithm 200, the monitoring algorithm 200 determines whether the system 100 is in a substantial shut down state 202. If the system 100 is not in a substantial shut down state 202, control of the monitoring algorithm 200 is returned to the start.

In one aspect of the monitoring algorithm 200, if the monitoring algorithm 200 determines that the system 100 is in a substantial shut down state 202, a timer is initiated, and a predetermined waiting time is imposed prior to measuring the current refrigerant charge (CRC).

However, if the monitoring algorithm 200 determines the system 100 is in a substantial shut down state 202, the monitoring algorithm 200 determines if there is data corresponding to a previous refrigerant charge (PRC). If there is no data corresponding to a previous refrigerant charge, the control algorithm advances to the initialization state 204. During the initialization state 204, the control initializes the reference map, the system 100 preferably generates an alert to notify service personnel authorized to access the reference map and to initialize the system, providing data corresponding to an initial refrigerant charge. In the interim, the initialization state 204 preferably accesses a default map to provide data corresponding to a default refrigerant charge (DRC), such as data provided with factory preset values and the algorithm advances to the monitoring state 206. However, if the monitoring algorithm 200 determines there is data corresponding to a previous refrigerant charge, such as the refrigerant charge associated with the most recent previous substantial shut down of system 100, the algorithm advances to the monitoring state 206, bypassing the initialization state 204.

In the monitoring state 206, the sensors of the system gather data and transmit data signals to the control 140 for processing and comparison of measured values to the values in the reference map, such as data corresponding to the current refrigerant charge (CRC) compared to a default or initial refrigerant charge (DRC) or a previously measured or previous refrigerant charge (PRC). If the measured values (i.e., CRC compared to DRC/PRC) fall within a preselected or allowable range of values stored in the reference map for corresponding refrigerant charge(s), the monitoring algorithm returns to the start. In the monitoring state 206, the control 140 preferably stores the measured values corresponding to the current refrigerant charge (CRC). However, if the measured values (i.e., CRC compared to DRC/PRC) do not fall within a preselected or allowable range of values stored in the reference map for corresponding refrigerant charge(s), the monitoring algorithm advances to the alert state 208. In the alert state 208, the control 140 preferably stores the measured values corresponding to the current refrigerant charge, and generates and transmits an alert message to a user interface 180, whether by wired or wireless means. Depending upon the measured values corresponding to the current refrigerant charge (i.e., CRC compared to DRC/PRC), the system may then return to the start of the monitoring algorithm (e.g., if the CRC is 5 percent less than DRC/PRC), or may advance to the end of the algorithm. If control of the algorithm advances to the end, intervention by maintenance personnel is required prior to the system 100 being permitted to operate in order to prevent possible damage to the system 100 resulting from operating with a refrigerant charge that is too low.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A system for detecting low refrigerant charge in a refrigeration system comprising:

a compressor, a condenser, and an evaporator interconnected by a refrigerant line and forming a closed refrigerant circuit;

at least one sensor to sense at least a refrigerant charge after at least substantial shut down of the system of sufficient time duration such that temperatures of the condenser and evaporator are substantially equal to each other;

a control panel comprising a microprocessor, a memory device, and an interface board;

the control panel being in communication with the sensor to receive data signals corresponding to at least the refrigerant charge after the at least substantial shut down of the system;

the memory device storing data corresponding to a value of at least a sensed refrigerant charge after a previous at least substantial shut down of the system;

the microprocessor executing a computer algorithm to receive the data signals after the at least substantial shut down of the system, to compare the received data signals corresponding to the refrigerant charge after the at least substantial shut down of the system with the corresponding value from the data for the sensed refrigerant charge after the previous at least substantial shut down of the system, to detect a system defect relating to low refrigerant charge based on the comparison, and to generate an alert for a user in response to the detection of the system defect; and the interface board transmitting the at least one alert to a user interface.

2. The system of claim 1, wherein the sensor is a capacitance probe.

3. The system of claim 1, wherein the previous at least substantial shut down of the system is a most recent previous at least substantial shut down of the system.

4. The system of claim 1, wherein the system defect relating to low refrigerant charge corresponds to the refrigerant charge after the at least substantial shut down of the system being between about 2 percent and about 10 percent less than the corresponding value from the data for the sensed refrigerant charge after the previous at least substantial shut down of the system.

5. The system of claim 1, wherein the system defect relating to low refrigerant charge corresponds to the refrigerant charge after the at least substantial shut down of the system being between about 2 percent and about 5 percent less than the corresponding value from the data for the sensed refrigerant charge after the previous at least substantial shut down of the system.

6. The system of claim 1, wherein the system defect relating to low refrigerant charge corresponds to the refrigerant charge after the at least substantial shut down of the system being between about 3 percent and about 5 percent less than the corresponding value from the data for the sensed refrigerant charge after the previous at least substantial shut down of the system.

7. The system of claim 1, wherein the system defect relating to low refrigerant charge corresponds to the refrigerant charge after the at least substantial shut down of the system being between about 4 percent and about 5 percent less than the corresponding value from the data for the sensed refrigerant charge after the previous at least substantial shut down of the system.

8. The system of claim 1, wherein the system defect relating to low refrigerant charge corresponds to the refrigerant charge after the at least substantial shut down of the system being about 2 percent less than the corresponding value from the data for the sensed refrigerant charge after the previous at least substantial shut down of the system.

9. The system of claim 1, wherein the system defect relating to low refrigerant charge corresponds to the refrigerant charge after the at least substantial shut down of the system being about 5 percent less than the corresponding value from the data for the sensed refrigerant charge after the previous at least substantial shut down of the system.

10. The system of claim 1, wherein the at least substantial shut down of the system corresponds with cessation of the compressor spinning.

11. A method of detecting low refrigerant charge in a refrigeration system comprising:

performing at least substantial shut down of the system;

sensing a refrigerant charge after the at least substantial shut down of the system;

comparing the refrigerant charge after the at least substantial shut down of the system with a refrigerant charge after a previous at least substantial shut down of the system; and generating an alert in response to a predetermined reduction of the refrigerant charge.

12. The method of claim 11, wherein the refrigerant charge after the previous at least substantial shut down of the system is a most recent previous at least substantial shut down of the system.

13. The method of claim 11, wherein sensing a refrigerant charge after the at least substantial shut down of the system includes waiting a predetermined time period after the at least substantial shut down of the system prior to sensing the refrigerant charge.

14. The method of claim 13, wherein the predetermined time period after the at least substantial shut down corresponds to at least a time period required for a temperature of liquid refrigerant of a condenser of the system being substantially equal to a temperature of liquid refrigerant of an evaporator of the system.

15. The method of claim 11, wherein the predetermined reduction of the refrigerant charge corresponds to the refrigerant charge after the at least substantial shut down of the system being between about 2 percent and about 10 percent less than the corresponding value from the data for the sensed refrigerant charge after the previous at least substantial shut down of the system.

16. The method of claim 11, wherein the predetermined reduction of the refrigerant charge corresponds to the refrigerant charge after the at least substantial shut down of the system being between about 2 percent and about 5 percent less than the corresponding value from the data for the sensed refrigerant charge after the previous at least substantial shut down of the system.

17. The method of claim 11, wherein the predetermined reduction of the refrigerant charge corresponds to the refrigerant charge after the at least substantial shut down of the system being between about 3 percent and about 5 percent less than the corresponding value from the data for the sensed refrigerant charge after the previous at least substantial shut down of the system.

18. The method of claim 11, wherein the predetermined reduction of the refrigerant charge corresponds to the refrigerant charge after the at least substantial shut down of the system being between about 4 percent and about 5 percent less than the corresponding value from the data for the sensed refrigerant charge after the previous at least substantial shut down of the system.

19. The method of claim 11, wherein the predetermined reduction of the refrigerant charge corresponds to the refrigerant charge after the at least substantial shut down of the system being about 2 percent less than the corresponding value from the data for the sensed refrigerant charge after the previous at least substantial shut down of the system.

20. The method of claim 11, wherein the predetermined reduction of the refrigerant charge corresponds to the refrigerant charge after the at least substantial shut down of the system being about 5 percent less than the corresponding value from the data for the sensed refrigerant charge after the previous at least substantial shut down of the system.

21. The method of claim 11 comprising storing data corresponding to a value of the refrigerant charge after the at least substantial shut down of the system.

* * * * *